US012808311B2

(12) United States Patent
Jiang et al.

(10) Patent No.: US 12,808,311 B2
(45) Date of Patent: Nov. 24, 2026

(54) MUFFLER FOR GENERATING A SPORTY AND RHYTHMIC SOUND AND A VEHICLE EQUIPPED WITH THE SAME

(71) Applicants: HYUNDAI MOTOR COMPANY, Seoul (KR); KIA CORPORATION, Seoul (KR)

(72) Inventors: Kun Peng Jiang, Yantai (CN); Jay Yon Jo, Ansan-si (KR); Wen Biao Liu, Yantai (CN)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 449 days.

(21) Appl. No.: 18/370,797

(22) Filed: Sep. 20, 2023

(65) Prior Publication Data

US 2024/0102408 A1 Mar. 28, 2024

(30) Foreign Application Priority Data

Sep. 26, 2022 (CN) ..... 202211173131.0

(51) Int. Cl.
*F01N 1/04* (2006.01)

(52) U.S. Cl.
CPC ..... *F01N 1/04* (2013.01); *F01N 2310/02* (2013.01); *F01N 2490/15* (2013.01)

(58) Field of Classification Search
CPC .. F01N 2470/14; F01N 2490/15; F01N 1/023; F01N 2240/36; F01N 2470/02;
(Continued)

(56) References Cited

U.S. PATENT DOCUMENTS 3,243,012 A * 3/1966 Powers ..... F01N 1/02 181/266
8,051,949 B2 * 11/2011 Henke ..... F01N 1/08 181/251

(Continued)

FOREIGN PATENT DOCUMENTS

CN 201581959 U 9/2010
CN 205936763 U 2/2017

(Continued)

*Primary Examiner* — Forrest M Phillips
(74) *Attorney, Agent, or Firm* — Lempia Summerfield Katz LLC

(57) ABSTRACT

A muffler generates a sporty and rhythmic sound for a vehicle. The muffler includes a housing, first and second baffles, an inlet pipe, and left and right exhaust pipes. The first and second baffles the housing interior into left, intermediate, and right chambers. The left and right chambers include a sound absorber and the inlet pipe extends from a front of the housing into the intermediate chamber. A first end of the left exhaust pipe is in the intermediate chamber, a second end of the left exhaust pipe penetrates the left chamber and extends out of the housing, and a plurality of first through-holes is in a portion of the left exhaust pipe in the left chamber. A first end of the right exhaust pipe is in the intermediate chamber, a second end of the right exhaust pipe penetrates the right chamber and extends out of the housing, and a plurality of second through-holes is in a portion of the right exhaust pipe in the right chamber. Exhaust gas introduced through the inlet pipe is discharged from the housing through the left and right exhaust pipes.

9 Claims, 13 Drawing Sheets

(58) Field of Classification Search
CPC .... F01N 2470/18; F01N 1/04; F01N 2310/02; F01N 1/083; F01N 1/084; F01N 1/089; F01N 3/005; F01N 1/082; F01N 1/10; G10K 11/161; G10K 11/172
See application file for complete search history.

(56) References Cited

U.S. PATENT DOCUMENTS

| | | | | |
|---|---|---|---|---|
| 8,579,077 | B2 * | 11/2013 | Ahn | F01N 1/04 181/254 |
| 8,684,131 | B1 * | 4/2014 | Park | F01N 1/04 181/239 |
| 9,133,753 | B2 * | 9/2015 | Vollmer | F01N 1/003 |
| 9,429,052 | B2 | 8/2016 | Hörr | |
| 9,638,077 | B2 | 5/2017 | Hörr | |
| 10,208,639 | B2 * | 2/2019 | Lee | F01N 1/006 |
| 10,450,912 | B2 * | 10/2019 | Donnelly | F01N 1/083 |
| 2015/0354421 | A1 | 12/2015 | Hörr | |
| 2016/0333756 | A1 | 11/2016 | Hörr | |

FOREIGN PATENT DOCUMENTS

| | | | |
|---|---|---|---|
| CN | 207686793 | U | 8/2018 |
| CN | 110863891 | A | 3/2020 |
| CN | 210509350 | U | 5/2020 |
| CN | 211737261 | U | 10/2020 |
| CN | 111911274 | A | 11/2020 |
| JP | 6063002 | B2 | 1/2017 |
| KR | 100950997 | B1 | 4/2010 |

* cited by examiner

MUFFLER FOR GENERATING A SPORTY AND RHYTHMIC SOUND AND A VEHICLE EQUIPPED WITH THE SAME

CROSS-REFERENCE TO RELATED APPLICATION

This application claims priority to and the benefit of Chinese Patent Application No. 202211173131.0 filed with the China National Intellectual Property Administration on Sep. 26, 2022, the entire contents of which are incorporated herein by reference.

BACKGROUND OF THE DISCLOSURE

(a) Technical Field

The present disclosure relates to vehicles, and more particularly, to a muffler for generating a sporty and rhythmic sound and a vehicle equipped with the same.

(b) Description of the Related Art

In general, an exhaust gas from a vehicle causes noise with various frequencies. Some consumers like to hear an exhaust sound that is sporty and rhythmic without harsh noise.

In order to meet the requirement, some vehicles are equipped with mufflers capable of generating a sporty and rhythmic sound. For example, Chinese Utility Model Registration No. ZL201921357337.2 discloses a muffler that allows an exhaust gas to have a sporty and rhythmic sound by using a high-frequency silencing pipe having an expansion chamber and two exhaust branch passageways, which satisfies the consumer's needs. However, in the above-mentioned structure, sound volumes and frequencies of the sporty and rhythmic sound generated at two opposite left and right sides of a vehicle are not identical to each other.

Therefore, mufflers in the related art need to be further improved.

The above information disclosed in this Background section is only to enhance understanding of the background of the disclosure. Therefore, the Background section may contain information that does not form the prior art that is already known to a person of ordinary skill in the art.

SUMMARY OF THE DISCLOSURE

The present disclosure has been made in an effort to provide a muffler for generating a sporty and rhythmic sound and to provide a vehicle equipped with the same. The muffler may generate the sporty and rhythmic sound and identical sporty and rhythmic sounds are generated at two opposite left and right sides of a vehicle.

An embodiment of the present disclosure provides a muffler for generating a sporty and rhythmic sound. The muffler may include a housing, a first baffle, a second baffle, an inlet pipe, a left exhaust pipe, and a right exhaust pipe. The first baffle and the second baffle may be symmetrically installed in the housing and divide an internal space of the housing into a left chamber, an intermediate chamber, and a right chamber. The left chamber and the right chamber may each be filled with a sound absorber. The inlet pipe may extend from a front side of the housing into the intermediate chamber and communicate with the intermediate chamber. A first end of the left exhaust pipe may be positioned in the intermediate chamber and a second end of the left exhaust pipe may penetrate the left chamber and then extend to an outside of the housing. A plurality of first through-holes may be formed in a portion of the left exhaust pipe that is positioned in the left chamber. A first end of the right exhaust pipe may be positioned in the intermediate chamber and a second end of the right exhaust pipe may penetrate the right chamber and then extend to the outside of the housing. A plurality of second through-holes may be formed in a portion of the right exhaust pipe that is positioned in the right chamber. An exhaust gas introduced through the inlet pipe may be discharged to the outside of the housing through the left exhaust pipe and the right exhaust pipe. The sound absorber in the left chamber may absorb high-frequency noise of the exhaust gas in the left exhaust pipe and the sound absorber in the right chamber may absorb the high-frequency noise of the exhaust gas in the right exhaust pipe.

A third baffle and a fourth baffle may be further provided symmetrically in the housing. The third baffle may divide the left chamber into a left outer chamber and a left inner chamber. A plurality of third through-holes may be formed in the third baffle to allow the left outer chamber and the left inner chamber to communicate with each other. The fourth baffle may divide the right chamber into a right outer chamber and a right inner chamber. A plurality of fourth through-holes may be formed in the fourth baffle to allow the right outer chamber and the right inner chamber to communicate with each other.

Drain holes may be respectively formed in the first baffle, the second baffle, the third baffle, the fourth baffle, a left wall of the left chamber, and a right wall of the right chamber.

A first opening may be formed at an end portion of the inlet pipe that is positioned in the intermediate chamber, a second opening may be formed at an end portion of the first end of the left exhaust pipe, and a third opening may be formed at an end portion of the first end of the right exhaust pipe. The inlet pipe may introduce the exhaust gas into the intermediate chamber through the first opening. The exhaust gas introduced into the intermediate chamber may be introduced into the left exhaust pipe through the second opening and may be introduced into the right exhaust pipe through the third opening.

A plurality of fifth through-holes may be formed in a circumferential surface of the left exhaust pipe that is adjacent to the first end and a plurality of sixth through-holes may be formed in a circumferential surface of the right exhaust pipe that is adjacent to the first end.

The inlet pipe may communicate directly with the left exhaust pipe and the right exhaust pipe.

A plurality of seventh through-holes may be formed in a portion of the inlet pipe that is positioned in the intermediate chamber.

A plurality of eighth through-holes may be formed in the first baffle and the second baffle.

A bracket may be installed in the intermediate chamber to fix the inlet pipe.

Another embodiment of the present disclosure provides a vehicle equipped with the muffler for generating a sporty and rhythmic sound according to an embodiment.

The muffler of the present disclosure that serves to generate the sporty and rhythmic sound may absorb high-frequency noise using the left chamber itself, the sound absorber in the left chamber, the right chamber itself, and the sound absorber in the right chamber. Therefore, the sporty and rhythmic sound may be generated. In addition, the first baffle and the second baffle are symmetrically installed in the housing such that the left chamber and the right chamber are installed to be symmetric with respect to a vertical direction.

Therefore, the same high-frequency noise is absorbed at two opposite left and right sides of the muffler and the same sporty and rhythmic sounds are generated at two opposite left and right sides of the vehicle.

The method and device according to the present disclosure may have other features and advantages. These features and advantages should become more clear from the accompanying drawings and the following embodiments or may be described in detail with reference to the accompanying drawings and the following embodiments. These drawings and embodiments are intended to aid in interpreting the specific principles of the present disclosure.

Figure 1:
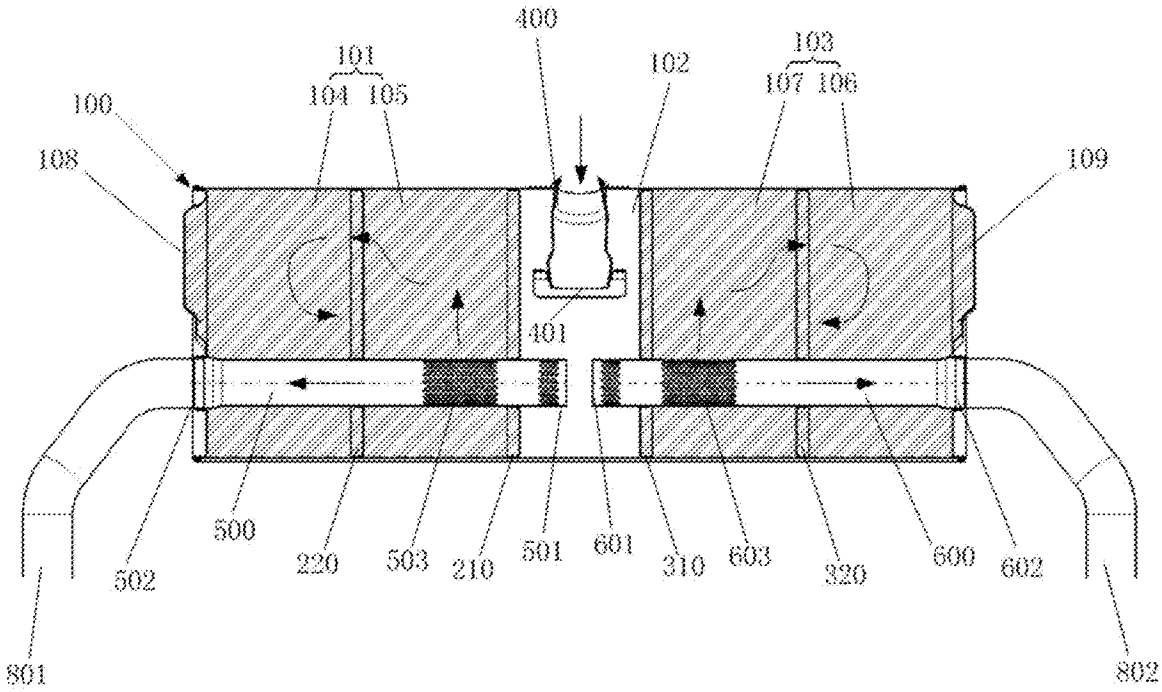
FIG. 1 is a schematic cross-sectional view of a muffler for generating a sporty and rhythmic sound according to an embodiment of the present disclosure.

It should be understood that the drawings simply represent features to describe the basic principles of the present disclosure and that the drawings are not necessarily drawn to scale. Specific design features (including specific sizes, directions, positions, and shapes, for example) disclosed in the present disclosure will be partially and specifically determined depending on applications and environments in which the disclosed mufflers are to be used.

In these drawings, the same reference numerals indicate the same or equivalent parts of the present disclosure throughout the plurality of drawings.

DETAILED DESCRIPTION OF THE EMBODIMENTS

Hereinafter, respective embodiments of the present disclosure are described below in detail with reference to the drawings illustrating the embodiments. While the present disclosure is described with reference to various embodiments, it should be understood that the present specification is not intended to limit the present disclosure to the embodiments. On the contrary, the present disclosure includes not only the embodiments, but also various types of selected alternate forms, modified forms, equivalent forms, and other embodiments within the spirit of the present disclosure and the scope defined by the appended claims.

The present disclosure provides a muffler that is configured to generate a sporty and rhythmic sound by increasing a proportion of favorable noise (also called a 'sporty noise') in a sound of an exhaust gas. In this case, the favorable noise means a component of the sound of the exhaust gas that has low frequencies. It should be noted that all the components of the sound of the exhaust gas, which have low frequencies, are not favorable noise but include noise with low frequencies lower than the frequency of the favorable noise.

Hereinafter, a muffler for generating a sporty and rhythmic sound according to an embodiment of the present disclosure is described with reference to FIGS. 1-13.

Figure 2:
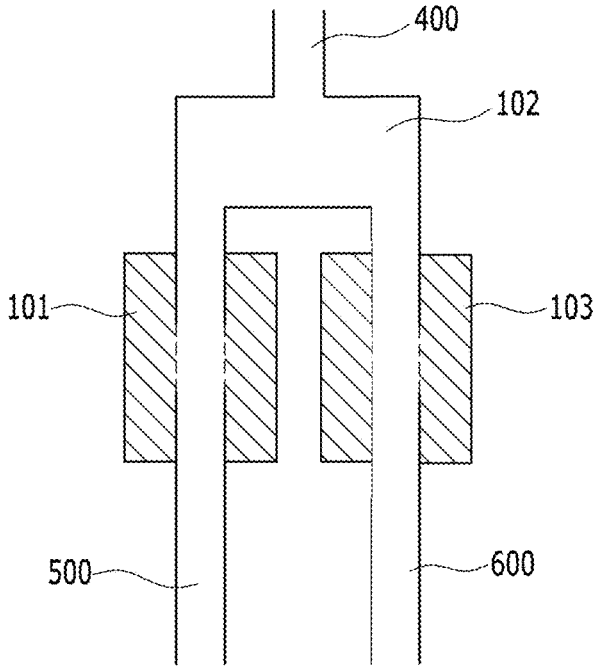
FIG. 2 is a view that is schematically illustrated based on functions of a muffler in FIG. 1.
Figure 6:
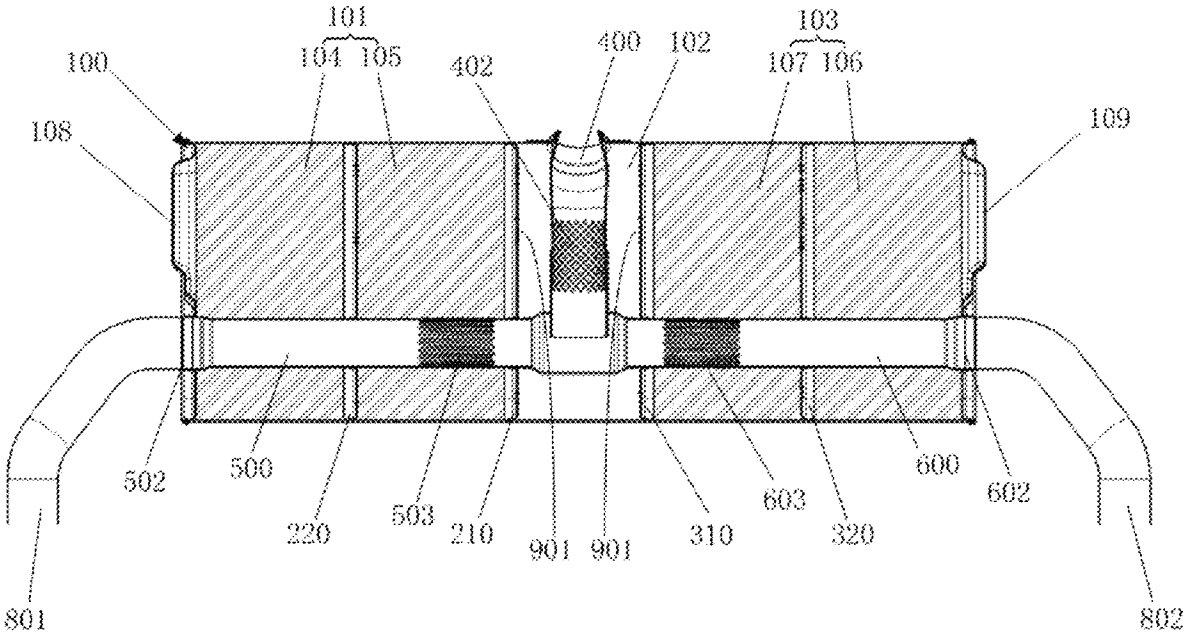
FIG. 6 is another schematic cross-sectional view of a muffler for generating a sporty and rhythmic sound according to an embodiment of the present disclosure.
Figure 7:
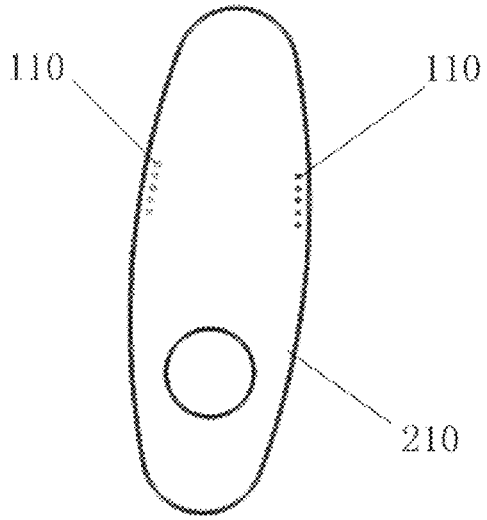
FIG. 7 is a schematic view of a first baffle of the muffler in FIG. 6.
Figure 8:
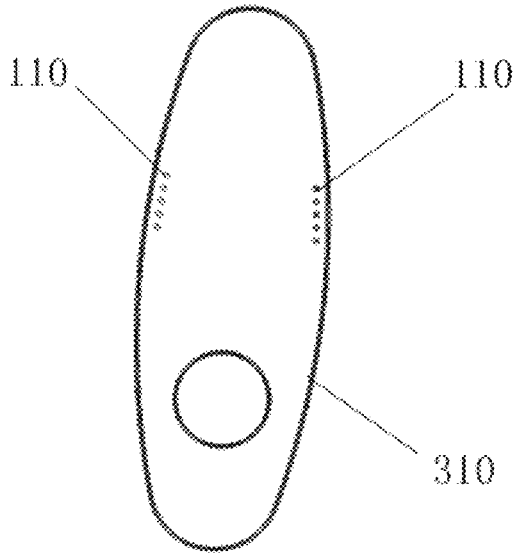
FIG. 8 is a schematic view of a second baffle of the muffler in FIG. 6.

As illustrated in FIGS. 1, 2, and 6, a muffler for generating a sporty and rhythmic sound according to an embodiment of the present disclosure includes a housing 100, a first baffle 210, a second baffle 310, an inlet pipe 400, a left exhaust pipe 500, and a right exhaust pipe 600. The muffler in FIG. 1 may be simplified based on the functions, as illustrated in FIG. 2.

The housing 100 is mounted at a lower side of a rear portion of a vehicle body. Specifically, a length direction of the housing 100 corresponds to a leftward/rightward direction or width direction of the vehicle.

The first baffle 210 and the second baffle 310 are symmetrically installed in the housing 100 and divide an internal space of the housing 100 into a left chamber 101, an intermediate chamber 102, and a right chamber 103. The left chamber 101 and the right chamber 103 are each filled with a sound absorber.

The inlet pipe 400 extends into the intermediate chamber 102 from a front side of the housing 100 and communicates with the intermediate chamber 102.

A first end 501 of the left exhaust pipe 500 is positioned in the intermediate chamber 102. A second end 502 of the left exhaust pipe 500 penetrates the left chamber 101 and then extends to an outside of the housing 100 (i.e., to a left side of the housing 100). A plurality of first through-holes 503 is formed in a portion of the left exhaust pipe 500 that is positioned in the left chamber 101.

A first end 601 of the right exhaust pipe 600 is positioned in the intermediate chamber 102. A second end 602 of the right exhaust pipe 600 penetrates the right chamber 103 and extends to the outside of the housing 100 (i.e., to a right side of the housing 100). A plurality of second through-holes 603 is formed in a portion of the right exhaust pipe 600 that is positioned in the right chamber 103.

The exhaust gas, which is introduced into the intermediate chamber 102 through the inlet pipe 400, may be discharged to the outside of the housing 100 through the left exhaust pipe 500 and the right exhaust pipe 600. The sound absorber in the left chamber 101 serves to absorb high-frequency noise of the exhaust gas in the left exhaust pipe 500. The sound absorber in the right chamber 103 serves to absorb the high-frequency noise of the exhaust gas in the right exhaust pipe 600. The sound absorber may increase a proportion of a favorable low-frequency noise in the sound of the exhaust gas, thereby generating or helping to generate a sporty and rhythmic sound.

The left chamber 101 itself, the sound absorber in the left chamber 101, the right chamber 103 itself, and the sound absorber in the right chamber 103 may be used to absorb the high-frequency noise, thereby generating helping to generate the sporty and rhythmic sound. In addition, the first baffle 210 and the second baffle 310 are symmetrically installed in the housing 100, such that the left chamber 101 and the right chamber 103 are installed to be symmetric with respect to a vertical direction. Therefore, the same high-frequency noises are absorbed at two opposite left and right sides of the muffler, and thus the same sporty and rhythmic sounds are generated at two opposite left and right sides of the vehicle.

Specifically, the sound of the exhaust gas in the left exhaust pipe 500 is transmitted into the left chamber 101 through the first through-holes 503, and the sound of the exhaust gas in the right exhaust pipe 600 is transmitted into the right chamber 103 through the second through-holes 603.

In one aspect, the left chamber 101 itself may be considered as the Helmholtz chamber and absorb the high-frequency noise of the exhaust gas in the left exhaust pipe 500. Similarly, the right chamber 103 itself may be considered as the Helmholtz chamber and absorb the high-frequency noise of the exhaust gas in the right exhaust pipe 600.

In another aspect, the sound absorber in the left chamber 101 may absorb the high-frequency noise of the exhaust gas in the left exhaust pipe 500, and the sound absorber in the right chamber 103 may absorb the high-frequency noise of the exhaust gas in the right exhaust pipe 600.

Specifically, the sound absorber may be a sound absorber made of glass wool or other fibers. In this case, a type of the sound absorber is not limited thereto. The sound absorber may be any type of sound absorbing material in the related art as long as the sound absorber may perform the above-mentioned function.

In an embodiment, the first through-holes 503 of the left exhaust pipe 500 and the second through-holes 603 of the right exhaust pipe 600 are identical in the number of holes, the hole diameter size, the spacing, and the position relative to one another. Thus, as a result, the frequency of the high-frequency noise absorbed by the left chamber 101 and the frequency of the high-frequency noise absorbed by the right chamber 103 are equal to one another. Therefore, the same sporty and rhythmic sounds are generated at the two opposite left and right sides of the vehicle.

In an embodiment, the number of first through-holes 503 is set to 512, but the number of first through-holes 503 may be adjusted depending on the circumstances. For example, the number of first through-holes 503 may be set to any number between 500 and 550.

In an embodiment, a diameter of each first through-hole 503 may be 3 mm, but the diameter of each first through-hole 503 may be adjusted depending on the circumstances. For example, the diameter of each first through-hole 503 may be set to any numerical value between 1.5 and 4 mm.

Because the second through-holes 603 are identical in dimension and number to the first through-holes 503, a description of the second through-holes 603 has been omitted.

Figure 3:
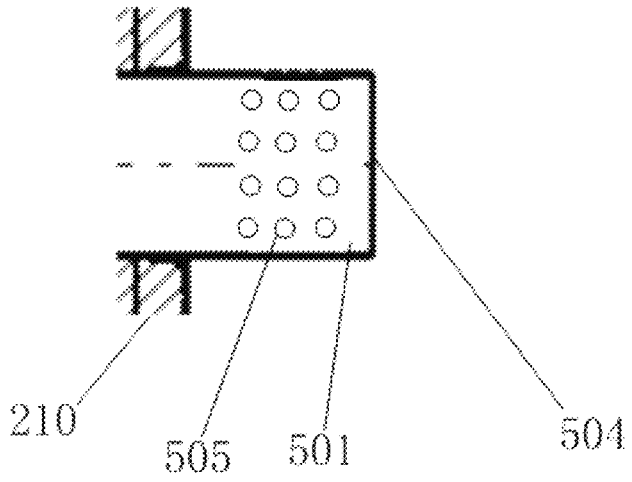
FIG. 3 is a partially enlarged view of a first end of a left exhaust pipe of the muffler in FIG. 1.
Figure 4:
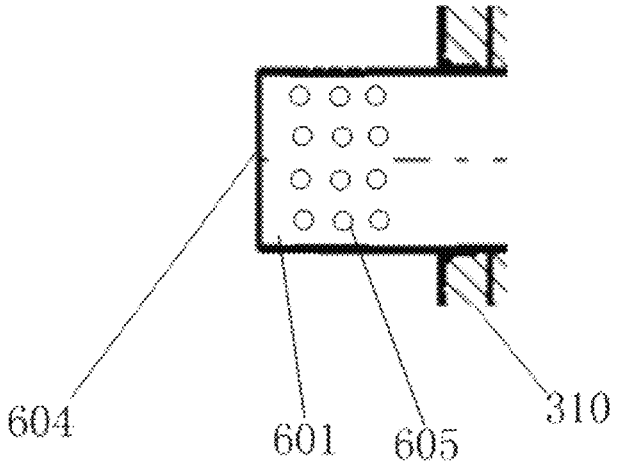
FIG. 4 is a partially enlarged view of a first end of a right exhaust pipe of the muffler in FIG. 1.

In an embodiment, as illustrated in FIG. 1, a first opening 401 is formed at an end of the inlet pipe 400 positioned in the intermediate chamber 102. As illustrated in FIG. 3, a second opening 504 is formed at an end portion of the first end 501 of the left exhaust pipe 500. As illustrated in FIG. 4, a third opening 604 is formed at an end portion of the first end 601 of the right exhaust pipe 600.

The inlet pipe 400 may introduce the exhaust gas into the intermediate chamber 102 through the first opening 401. The intermediate chamber 102 may correspond to an expansion chamber and absorb a low-frequency noise in the exhaust gas introduced into the intermediate chamber 102.

The exhaust gas introduced into the intermediate chamber 102 may be introduced into the left exhaust pipe 500 through the second opening 504. The exhaust gas introduced into the intermediate chamber 102 may be introduced into the right exhaust pipe 600 through the third opening 604. The inlet pipe 400, the left exhaust pipe 500, and the right exhaust pipe 600 communicate with each other such that the exhaust gas introduced through the inlet pipe 400 may be discharged to the outside of the housing 100 through the left exhaust pipe 500 and the right exhaust pipe 600.

In an embodiment, as illustrated in FIGS. 1 and 3, a plurality of fifth through-holes 505 may be formed in a circumferential surface of the left exhaust pipe 500 that is adjacent to the first end 501. The fifth through-holes 505 may allow the exhaust gas, which is introduced into the intermediate chamber 102, to quickly enter the left exhaust pipe 500.

As illustrated in FIGS. 1 and 4, a plurality of sixth through-holes 605 may be formed in a circumferential surface of the right exhaust pipe 600 that is adjacent to the first end 601. The sixth through-holes 605 may allow the exhaust gas, which is introduced into the intermediate chamber 102, to quickly enter the right exhaust pipe 600.

In an embodiment, as shown in FIG. 1, the left chamber 101 and the right chamber 103 absorb the high-frequency noise, and the intermediate chamber 102 is also used to absorb the low-frequency noise.

In the case that the intermediate chamber 102 absorbs the low-frequency noise, a large amount of the low-frequency noise with the frequency lower than the frequency of the favorable noise is absorbed, but a relatively small amount of the favorable noise is absorbed. Therefore, finally, the sporty and rhythmic sound may be generated as the proportion of the favorable noise in the sound of the exhaust gas increases.

In an embodiment, the sixth through-holes 605 are identical in number, hole diameter size, spacing, and position to the fifth through-holes 505.

In an embodiment, the number of fifth through-holes 505 is set to 128, but the number of fifth through-holes 505 may be adjusted depending on the circumstances. For example, the number of fifth through-holes 505 may be set to any number between 100 and 200.

In an embodiment, a diameter of each fifth through-hole 505 may be 3 mm, but the diameter of each fifth through-hole 505 may be adjusted depending on the circumstances. For example, the diameter of each fifth through-hole 505 may be set to any numerical value between 1.5 and 4 mm.

Because the sixth through-holes 605 are identical in dimension and number to the fifth through-holes 505, a description of the sixth through-holes 605 has been omitted.

In another embodiment, as illustrated in FIG. 6, the inlet pipe 400 is connected to the left exhaust pipe 500 and the right exhaust pipe 600. The inlet pipe 400 communicates directly with the left exhaust pipe 500 and the right exhaust pipe 600 in this embodiment. Thus, as a result, the exhaust gas introduced through the inlet pipe 400 may be discharged to the outside of the housing 100 through the left exhaust pipe 500 and the right exhaust pipe 600.

In an embodiment, as shown in FIG. 6, the exhaust gas introduced through the inlet pipe 400 is not introduced into the intermediate chamber 102. Thus, the intermediate chamber 102 does not absorb the low-frequency noise. Therefore, it is possible to prevent the favorable noise from being absorbed by the intermediate chamber 102. In addition, the left chamber 101 and the right chamber 103 may absorb the high-frequency noise, which may increase the proportion of the favorable noise in the sound of the exhaust gas. Therefore, the sporty and rhythmic sound may be generated.

In an embodiment, as shown in FIG. 6, a plurality of seventh through-holes 402 is formed in a portion of the inlet pipe 400 that is positioned in the intermediate chamber 102. Thus, the inlet pipe 400 and the intermediate chamber 102 communicate with each other. The intermediate chamber 102 itself may correspond to the Helmholtz chamber and absorb the high-frequency noise of the exhaust gas positioned in the inlet pipe 400.

In an embodiment, the number of seventh through-holes 402 is set to 360, but the number of seventh through-holes 402 may be adjusted depending on the circumstances. For example, the number of seventh through-holes 402 may be set to any number between 300 and 400.

In an embodiment, a diameter of each seventh through-hole 402 may be 3 mm, but the diameter of each seventh through-hole 402 may be adjusted depending on the circumstances. For example, the diameter of each seventh through-hole 402 may be set to any numerical value between 1.5 and 4 mm.

In an embodiment, as shown in FIG. 6, the first baffle 210 and the second baffle 310 additionally have a plurality of eighth through-holes 901. Therefore, the sound of the exhaust gas in the inlet pipe 400 may be transmitted to the left chamber 101 and the right chamber 103 through the seventh through-holes 402 and the eighth through-holes 901.

In other words, in the embodiment in FIG. 6, the sound of the exhaust gas may be transmitted to the left chamber 101 and the right chamber 103 through the seventh through-holes 402 and the eighth through-holes 901 as well as the first through-holes 503 of the left exhaust pipe 500 and the second through-holes 603 of the right exhaust pipe 600. The left chamber 101 and the right chamber 103 may be the Helmholtz chamber and thus absorb the high-frequency noise. In addition, the high-frequency noise may be absorbed by the sound absorbers in the left chamber 101 and the right chamber 103.

The eighth through-holes 901 of the second baffle 310 are identical in number, hole diameter size, spacing, and position to the eighth through-holes 901 of the first baffle 210. Thus, as a result, the frequency of the high-frequency noise absorbed by the left chamber 101 and the frequency of the high-frequency noise absorbed by the right chamber 103 may be equal to each other.

In an embodiment, the number of eighth through-holes 901 of the first baffle 210 is set to 360, but the number of eighth through-holes 901 may be adjusted depending on the circumstances. For example, the number of eighth through-holes 901 of the first baffle 210 may be set to any number between 300 and 400.

In an embodiment, the diameter of each eighth through-hole 901 of the first baffle 210 may be 3 mm, but the diameter of each eighth through-hole 901 may be adjusted depending on the circumstances. For example, the diameter of each eighth through-hole 901 of the first baffle 210 may be set to any numerical value between 1.5 and 4 mm.

Because the eighth through-holes 901 of the second baffle 310 are identical in dimension and number to the eighth through-holes 901 of the first baffle 210, a description of the eighth through-holes 901 of the second baffle 310 has been omitted.

Figure 5:
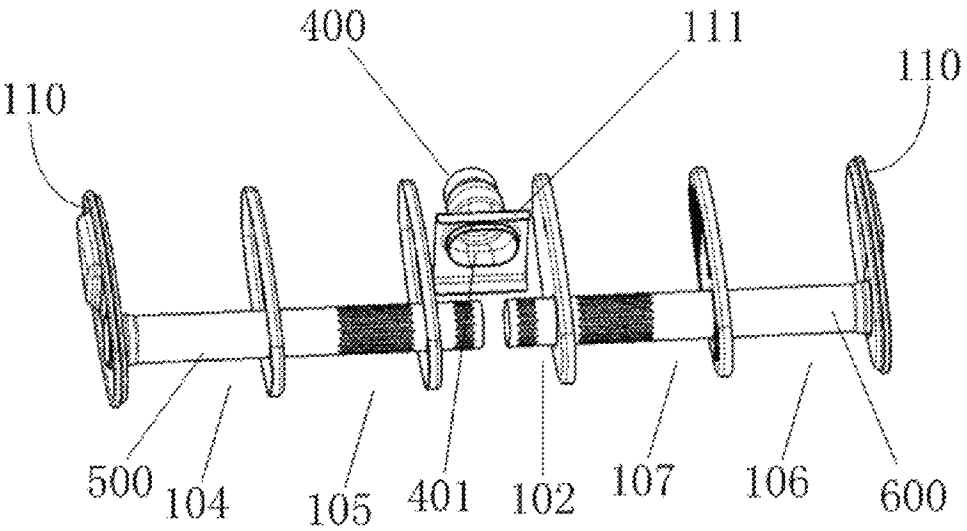
FIG. 5 is a schematic view illustrating an internal structure of the muffler in FIG. 1.

In an embodiment, as illustrated in FIGS. 1 and 5, a bracket 111 is installed in the intermediate chamber 102. The bracket 111 serves to fix the inlet pipe 400.

In an embodiment, as illustrated in FIGS. 1 and 6, a third baffle 220 and a fourth baffle 320 are additionally installed symmetrically in the housing 100.

Figure 9:
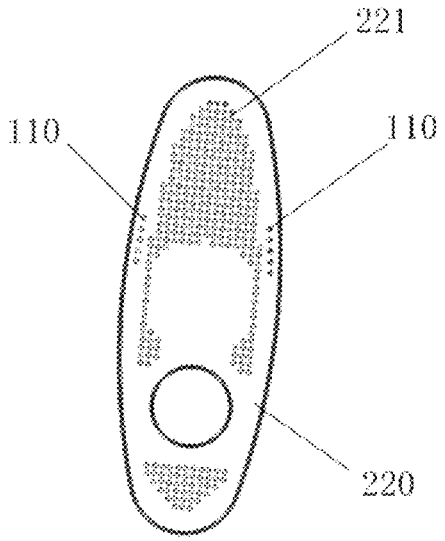
FIG. 9 is a schematic view of a third baffle of the muffler in FIG. 6.

The third baffle 220 divides the left chamber 101 into a left outer chamber 104 and a left inner chamber 105. As illustrated in FIG. 9, a plurality of third through-holes 221 is formed in the third baffle 220 to allow the left outer chamber 104 and the left inner chamber 105 to communicate with each other. The third baffle 220 may improve a strength of the left chamber 101.

Because of the presence of the third through-holes 220, the left outer chamber 104 and the left inner chamber 105 may still be considered as a single chamber.

Figure 10:
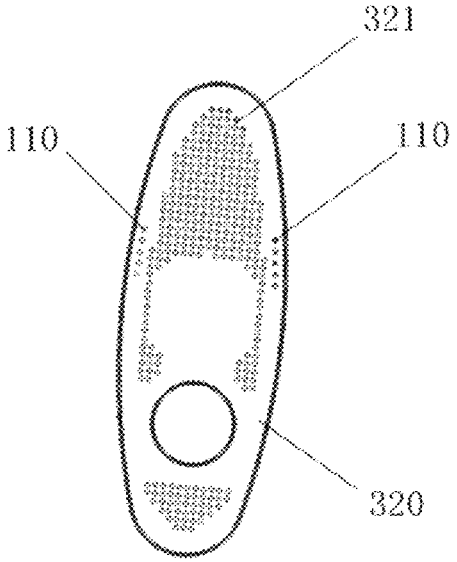
FIG. 10 is a schematic view of a fourth baffle of the muffler in FIG. 6.

The fourth baffle 320 divides the right chamber 103 into a right outer chamber 106 and a right inner chamber 107. As illustrated in FIG. 10, a plurality of fourth through-holes 321 is formed in the fourth baffle 320 to allow the right outer chamber 106 and the right inner chamber 107 to communicate with each other. The fourth baffle 320 may improve a strength of the right chamber 103.

Because of the presence of the fourth through-holes 321, the right outer chamber 106 and the right inner chamber 107 may still be considered as a single chamber.

In an embodiment, the fourth through-holes 321 of the fourth baffle 320 are identical in number, hole diameter size, spacing, and position to the third through-holes 221 of the third baffle 220. Thus, as a result, the frequency of the high-frequency noise absorbed by the left chamber 101 and the frequency of the high-frequency noise absorbed by the right chamber 103 may be equal to each other. Therefore, the same sporty and rhythmic sounds are generated at the two opposite left and right sides of the vehicle.

In an embodiment, the number of third through-holes 221 is set to 512, but the number of third through-holes 221 may be adjusted depending on the circumstances. For example, the number of third through-holes 221 may be set to any number between 500 and 550.

In an embodiment, the diameter of each third through-hole 221 may be 3 mm, but the diameter of each third through-hole 221 may be adjusted depending on the circumstances. For example, the hole diameter of each third through-hole 221 may be set to any numerical value between 1.5 and 4 mm.

Because the fourth through-holes 321 are identical in dimension and number to the third through-holes 221, a description of the fourth through-holes 321 has been omitted.

In an embodiment, as shown in FIGS. 1 and 6, the first through-holes 503 are formed at a position on the left exhaust pipe 500 corresponding to the left inner chamber 105, and the second through-holes 603 are formed at a position on the right exhaust pipe 600 corresponding to the right inner chamber 107.

As illustrated in FIG. 1, the sound of the exhaust gas introduced into the left exhaust pipe 500 may be transmitted from the first through-holes 503 to the left inner chamber 105 and transmitted to the left outer chamber 104 through the third through-holes 221. The left inner chamber 105 itself, which may be considered as the Helmholtz chamber, the sound absorber in the left inner chamber 105, the left outer chamber 104 itself, which may be considered as the Helmholtz chamber, and the sound absorber in the left outer chamber 104 may absorb the high-frequency noise.

The sound of the exhaust gas, which is introduced into the right exhaust pipe 600, may be transmitted from the second through-holes 603 to the right inner chamber 107 and transmitted to the right outer chamber 106 through the fourth through-holes 321. The right inner chamber 107 itself, which may be considered as the Helmholtz chamber, the sound absorber in the right inner chamber 107, the right outer chamber 106 itself, which may be considered as the Helmholtz chamber, and the sound absorber in the right outer chamber 106 may absorb the high-frequency noise.

In other embodiments, the first through-holes 503 may be formed at a position on the left exhaust pipe 500 corresponding to the left outer chamber 104 (this situation is not illustrated). Alternatively, the first through-holes 503 may be formed at both the position on the left exhaust pipe 500 corresponding to the left outer chamber 104 and the position on the left exhaust pipe 500 corresponding to the left inner chamber 105 (this situation is not illustrated).

Because setting the position of the second through-holes 603 is identical to setting the position of the first through-holes 503, a description of the second through-holes 603 has been omitted.

In an embodiment, as illustrated in FIGS. 5 and 7-10, drain holes 110 are respectively formed in the first baffle 210, the second baffle 310, the third baffle 220, the fourth baffle 320, a left wall 108 of the left chamber 101 (i.e., the left wall of the left outer chamber 104), and a right wall 109 of the right chamber 103 (i.e., the right wall of the right outer chamber 106).

The drain holes 110 may guide condensate water in the housing 100 to the outside of the housing 100. This is to prevent the condensate water from corroding the left outer chamber 104, the left inner chamber 105, the intermediate chamber 102, the right outer chamber 106, and the right inner chamber 107.

Another embodiment of the present disclosure provides a vehicle equipped with the muffler for generating a sporty and rhythmic sound.

Figure 11:
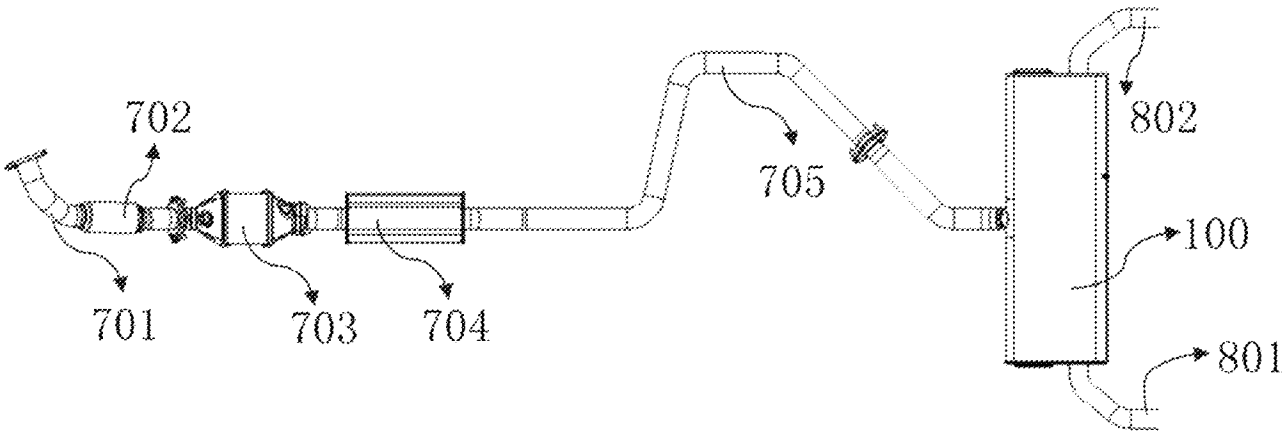
FIG. 11 is a schematic view illustrating connections between other components of a vehicle and a muffler for generating a sporty and rhythmic sound according to an embodiment of the present disclosure.

In an embodiment, as illustrated in FIG. 11, the vehicle further includes a pipe 701, a corrugated pipe 702, a tail or exhaust gas treatment device 703, an auxiliary muffler 704, and a pipe 705. The pipe 701, the corrugated pipe 702, the tail or exhaust gas treatment device 703, the auxiliary muffler 704, and the pipe 705 are sequentially disposed and communicate with one another.

The pipe 701 may communicate with an engine. The pipe 705 may communicate with the inlet pipe 400. The corrugated pipe 702 may absorb vibration transmitted from the engine to an exhaust line. The auxiliary muffler 704 may remove some of the high-frequency noise in advance.

As illustrated in FIGS. 1 and 11, the second end 502 of the left exhaust pipe 500 communicates with a left tail pipe 801, and the second end 602 of the right exhaust pipe 600 communicates with a right tail pipe 802. Thus, the exhaust gas is discharged to the outside of the housing 100 (i.e., the outside of the vehicle).

A result of evaluating vehicle noise may typically be expressed as an order. Using a four-cylinder vehicle as an example, the most important orders are C2 (second), C4 (fourth), C6 (sixth), and the like. In order to generate the sporty and rhythmic sound, a value of C2 needs to be as low as possible and a value of C4 needs to be as high as possible.

Figure 12:
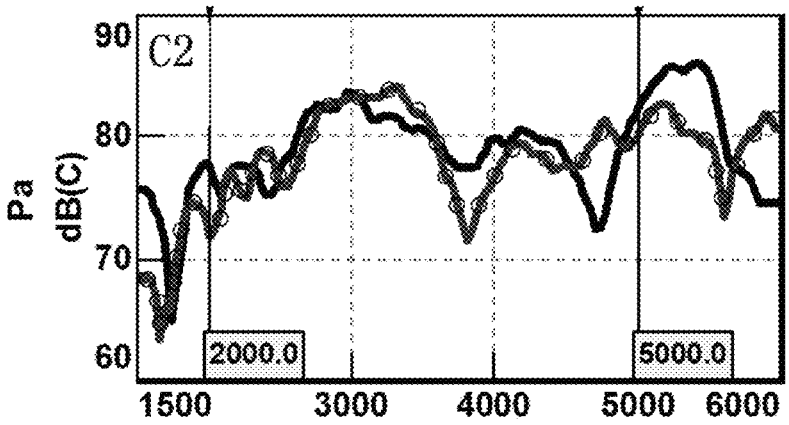
FIG. 12 is a graph illustrating C2 noise with respect to rotational speeds according to a result of testing the muffler in FIG. 1 and a muffler that does not generate a sporty and rhythmic sound.
Figure 13:
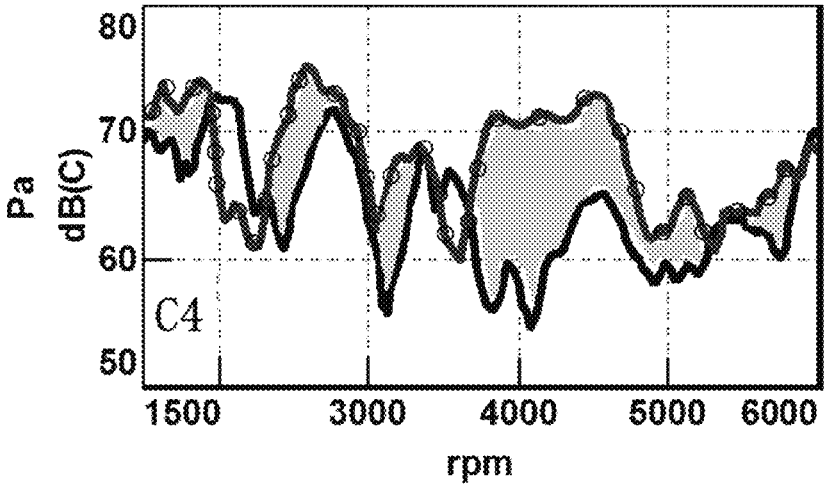
FIG. 13 is a graph illustrating C4 noise with respect to rotational speeds according to a result of testing the muffler in FIG. 1 and a muffler that does not generate a sporty and rhythmic sound.

FIGS. 12 and 13 are obtained by comparing the sound generated from a muffler constructed in accordance with the embodiment in FIG. 1 and the sound generated from a muffler in the related art that cannot generate the sporty and rhythmic sound. In other words, in both cases, FIGS. 12 and 13 were obtained by measuring C2 noise with respect to rotational speeds (i.e., engine revolutions per minute or rpm), measuring C4 noise with respect to rotational speeds, and plotting the noise with the same order with respect to the rotational speeds in the same drawing.

In FIGS. 12 and 13, "o" marks are added to curves representing the muffler of FIG. 1 to distinguish the curves from curves representing the muffler in the related art that cannot generate the sporty and rhythmic sound.

As illustrated in FIG. 12, at different rotational speeds, the C2 noise outputted from the muffler in FIG. 1 and the C2 noise outputted from the muffler in the related art, which cannot generate the sporty and rhythmic sound, are approximately identical to each other.

As illustrated in FIG. 13, the C4 noise from the muffler in FIG. 1 is higher than the C4 noise from the muffler in the related art that cannot generate the sporty and rhythmic sound. Specifically, within ranges of 1,500 to 2,000 rpm, 2,200 to 3,300 rpm, and 3,600 rpm to 6,000 rpm, the C4 noise from the muffler in FIG. 1 is higher than the C4 noise from the muffler in the related art that cannot generate the sporty and rhythmic sound.

As can be seen from the test result, the muffler of an embodiment of the present disclosure is much better than the muffler in the related art that cannot generate a sporty and rhythmic sound.

To better interpret and accurately define the appended claims and the embodiments described herein, the terms "upper", "lower", "inner", "outer", "upper surface", "lower surface", "upper side", "lower side", "upward", "downward", "front", "rear", "back", "inner side", "outer side", "inward", "outward", "inner portion", "outer portion", "inner", "outer", "forward", "rearward", and the like are intended to explain the features of the disclosed embodiments with reference to the positions of the features illustrated in the drawings.

The description of the specific implementations or embodiments of the present disclosure is intended for explanation and description of the inventive technical concepts. The above description is not comprehensive or intended to limit the disclosure to the disclosed exact form of the present disclosure. It should be apparent that some modifications and changes may be made depending on the above implication. The disclosed embodiments have been selected to interpret the specific principles of the present disclosure and their actual application. Others having ordinary skill in the art can use various exemplary embodiments and various replaceable methods and modifications of the present disclosure.

What is claimed is:

1. A muffler for generating a sporty and rhythmic sound, the muffler comprising: a housing; a first baffle; a second baffle; an inlet pipe; a left exhaust pipe; and a right exhaust pipe, wherein the first baffle and the second baffle are symmetrically installed in the housing and divide an internal space of the housing into a left chamber, an intermediate chamber, and a right chamber, wherein the left chamber and the right chamber are each filled with a sound absorber, wherein the inlet pipe extends from a front side of the housing into the intermediate chamber and communicates with the intermediate chamber, wherein a first end of the left exhaust pipe is positioned in the intermediate chamber, a second end of the left exhaust pipe penetrates the left chamber and then extends to an outside of the housing, wherein a plurality of first through-holes is formed in a portion of the left exhaust pipe that is positioned in the left chamber, wherein a first end of the right exhaust pipe is positioned in the intermediate chamber, a second end of the right exhaust pipe penetrates the right chamber and then extends to the outside of the housing, wherein a plurality of second through-holes is formed in a portion of the right exhaust pipe that is positioned in the right chamber, wherein an exhaust gas introduced through the inlet pipe is discharged to the outside of the housing through the left exhaust pipe and the right exhaust pipe, wherein the sound absorber in the left chamber absorbs high-frequency noise of the exhaust gas in the left exhaust pipe, wherein the sound absorber in the right chamber absorbs the high-frequency noise of the exhaust gas in the right exhaust pipe, wherein the muffler further includes a first opening at an end portion of the inlet pipe that is positioned in the intermediate chamber, a second opening at an end portion of the first end of the left exhaust pipe, and a third opening at an end portion of the first end of the right exhaust pipe, wherein the inlet pipe introduces the exhaust gas into the intermediate chamber through the first opening, wherein the exhaust gas introduced into the intermediate chamber is introduced into the left exhaust pipe through the second opening, and wherein the exhaust gas introduced into the intermediate chamber is introduced into the right exhaust pipe through the third opening.

2. The muffler of claim 1, further comprising:

a third baffle and a fourth baffle provided symmetrically in the housing, wherein the third baffle divides the left chamber into a left outer chamber and a left inner chamber, wherein a plurality of third through-holes is formed in the third baffle to allow the left outer chamber and the left inner chamber to communicate with each other, wherein the fourth baffle divides the right chamber into a right outer chamber and a right inner chamber, and wherein a plurality of fourth through-holes is formed in the fourth baffle to allow the right outer chamber and the right inner chamber to communicate with each other.

3. The muffler of claim 2, further comprising:

drain holes respectively formed in the first baffle, the second baffle, the third baffle, the fourth baffle, a left wall of the left chamber, and a right wall of the right chamber.

4. The muffler of claim 1, further comprising:

a plurality of fifth through-holes in a circumferential surface of the left exhaust pipe that is adjacent to the first end; and a plurality of sixth through-holes in a circumferential surface of the right exhaust pipe that is adjacent to the first end.

5. The muffler of claim 1, wherein the inlet pipe communicates directly with the left exhaust pipe and the right exhaust pipe.

6. The muffler of claim 5, further comprising:

a plurality of seventh through-holes in a portion of the inlet pipe that is positioned in the intermediate chamber.

7. The muffler of claim 5, further comprising:

a plurality of eighth through-holes in the first baffle and the second baffle.

8. The muffler of claim 1, further comprising:

a bracket installed in the intermediate chamber to fix the inlet pipe.

9. A vehicle equipped with the muffler for generating a sporty and rhythmic sound according to claim 1.

* * * * *